United States Patent [19]

Gachot et al.

[11] 3,934,611

[45] Jan. 27, 1976

[54] COMPARATOR FOR CODED SIGNALS REPRESENTED BY A PRESSURE OF FLUID

[76] Inventors: Jean Gachot, 26, avenue de Paris, Soisy-sous-Montmorency, Val d'Oise; Simeon Lekarski, 138, boulevard de la Republique, Saint Cloud, Hauts-de-Seine, both of France

[22] Filed: July 13, 1973

[21] Appl. No.: 378,993

[30] Foreign Application Priority Data

Aug. 4, 1972 France ..... 72.28245

[52] U.S. Cl. ..... 137/608; 251/611

[51] Int. Cl.[2] ..... F15C 3/04

[58] Field of Search.. 137/608; 235/201 ME, 201 R; 251/61.1

[56] References Cited

UNITED STATES PATENTS

| | | | |
|---|---|---|---|
| 3,176,516 | 4/1965 | Guenther | 251/138 X |
| 3,653,408 | 4/1972 | Coiner | 251/61.1 X |
| 3,680,590 | 8/1972 | Helinski | 137/608 |
| 3,702,909 | 11/1972 | Kraakman | 137/608 X |
| 3,750,707 | 8/1973 | Dordoni | 137/608 X |
| 3,768,521 | 10/1973 | Brychta et al. | 235/201 ME X |

*Primary Examiner*—Charles J. Myhre
*Assistant Examiner*—Ira S. Lazarus
*Attorney, Agent, or Firm*—Young & Thompson

[57] ABSTRACT

The comparator for signals which are coded in a given number system and represented by a fluid pressure comprises a first and a second rigid block pierced by transverse ducts which are arranged in a row and to which is applied a fluid pressure representing respectively a first and a second input signal, at least one elastic membrane which separates the two blocks, a first and a second discharge duct pierced in the second block on each side of the transverse ducts, means actuated by the pressure representing the second signal so as to deform the elastic membrane and to permit propagation of said pressure in the direction of the two output ducts, and means actuated by the pressure representing the first signal in order to deform the elastic membrane and to prevent propagation of the pressure representing the second signal beyond the duct corresponding to the first signal.

1 Claim, 7 Drawing Figures

COMPARATOR FOR CODED SIGNALS REPRESENTED BY A PRESSURE OF FLUID

This invention relates to a comparator for signals which are coded in a predetermined number system and represented by a pressure of fluid, said comparator being intended to deliver an output signal which is representative of the sign of the difference between the values of the input signals.

Comparators of this type for coded signals in the binary system are already known. These comparators are constituted by a large number of logical units which are therefore complex, delicate and costly.

The aim of the present invention is to permit the construction of a simple, rugged and compact comparator for signals which are represented by a high fluid pressure.

In accordance with the invention, the comparator for signals which are coded in a predetermined number system and represented by a fluid pressure essentially comprises a first and a second rigid block which are pierced by transverse ducts arranged in a row and adapted to receive a fluid pressure representing respectively a first and a second input signal, at least one elastic membrane which separates the two blocks, a first and a second discharge duct pierced in the second block on each side of the transverse ducts aforesaid, means actuated by the pressure representing the second signal in order to deform the elastic membrane and to permit propagation of said pressure in the direction of the two output ducts, and means actuated by the pressure representing the first signal in order to deform the elastic membrane and to prevent propagation of the pressure representing the second signal beyond the duct corresponding to the first signal.

In a preferred embodiment of the invention, the comparator comprises a rigid intermediate plate placed between the two blocks and separated from each block by a membrane. The plate is provided with open portions which are coaxial with the ducts of the two blocks and have a larger cross-sectional area than said ducts, and the second block is provided with cavities intercalated between the ducts of said block and each terminating on the second membrane in an orifice which is formed astride a partition-wall which forms a separation between two open portions of the intermediate plate.

Further particular features of the invention will become apparent from the detailed description which is given hereinafter.

A number of embodiments of the invention are shown in the accompanying drawings which are given by way of example without any limitation being implied, and in which.

In the accompanying drawings, the embodiments of the invention are adapted to signals which are coded in the decimal system but it will be wholly apparent that the invention is equally applicable to signals which are coded in other number systems such as the octal system.

Figure 1:
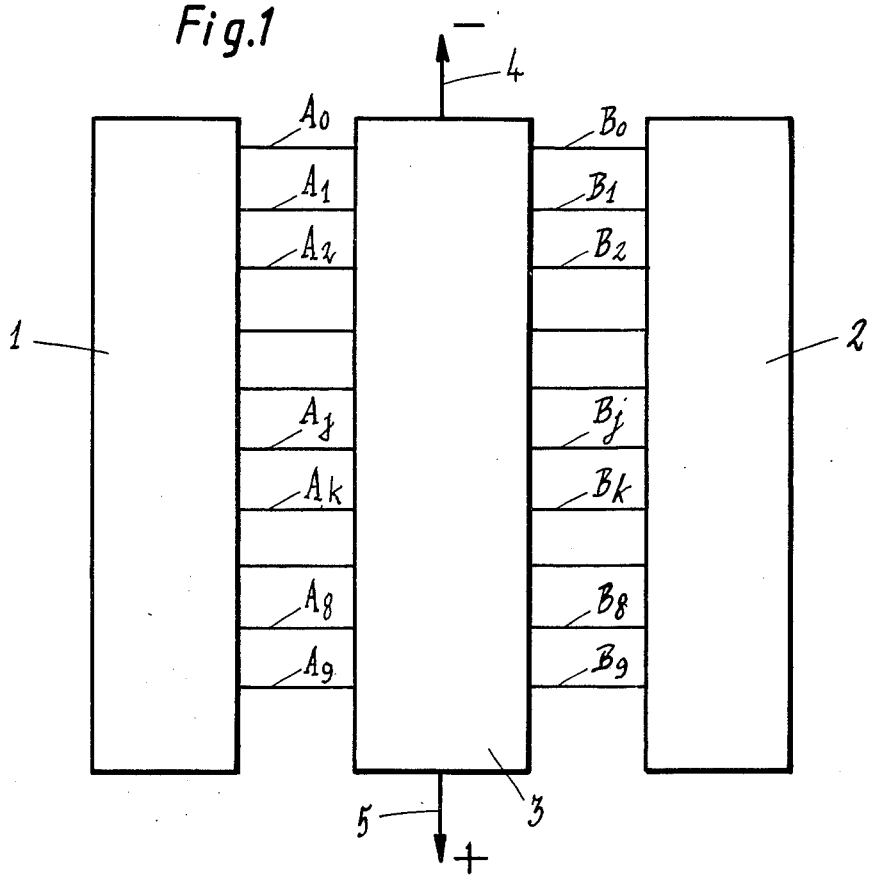
FIG. 1 is a diagram of a logical system comprising a comparator in accordance with the invention.

In the diagram shown in FIG. 1, a first decimal register 1 is connected by means of a first series of ten pipes A0 to A9 for fluid under pressure to a first input of a comparator 3. A second decimal register 2 is connected by means of a series of ten pipes B0 to B9 for fluid under pressure to a second input of the comparator 3. Two ducts 4 and 5 for fluid under pressure which are intended to transmit the output signal delivered by the comparator 3 are also connected to said comparator.

An item of information or datum A corresponding, for example, to a reference value of a quantity to be controlled is displayed in the register 1. The register 2 contains a variable datum B which corresponds, for example, to the instantaneous value of said quantity. The two data are sent to the comparator in the form of a high pressure of fluid such as compressed air, on the one hand in the one of the connecting pipes A0 to A9 and on the other hand in the one of the connecting pipes B0 to B9 whose order corresponds to the numerical value of the information as expressed in the decimal system.

If the data which are applied respectively to the two inputs of the comparator 3 have the same numerical value or in other words are transmitted via connecting pipes A and B of the same order, the comparator does not emit any output signal.

If said data have different values, the comparator 3 emits a signal which is represented by a fluid pressure either at its output 5 ("plus" signal) if B is larger than A or at its output 4 ("minus" signal) if B is smaller than A.

Figure 2:
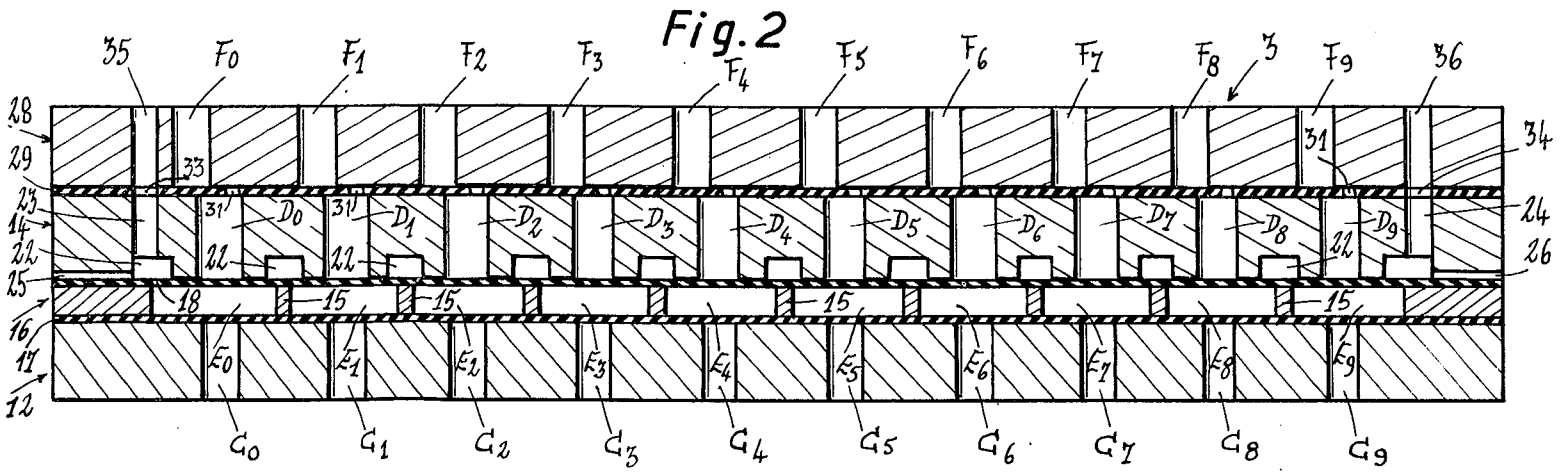
FIG. 2 is a sectional view of a first embodiment of the comparator which is shown in FIG. 1, said comparator being in the non-operating position.
Figure 3:
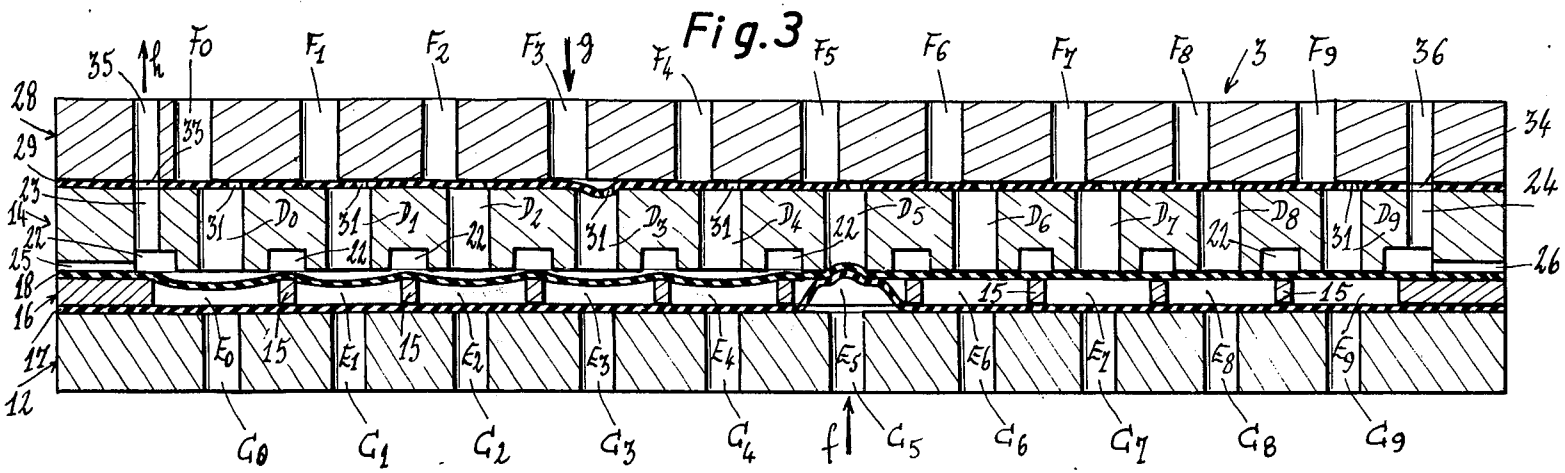
FIG. 3 is a view corresponding to FIG. 2 in which the comparator is in an operating position.

In the first embodiment of the invention which is illustrated in FIGS. 2 and 3, the comparator 3 comprises a first rigid block 12 pierced by a series of ten transverse ducts C0 to C9 which are adapted to be put into communication with a first series (not shown in the drawings) of connecting pipes such as the pipes A of FIG. 1 for a fluid under pressure representing a first input signal.

The comparator 3 further comprises a second rigid block 14 pierced by a series of ten transverse ducts D0 to D9, the orifices of which are located respectively opposite to those of the ducts C0 to C9.

There is placed between the blocks 12 and 14 a rigid intermediate plate 16 which is separated from each of these latter by an elastic membrane 17 and 18 respectively. The plate 16 is provided with a series of ten open portions E0 to E9 which are separated from each other by partitionwalls 15, said open portions being placed opposite to the orifices of the ducts C0 to C9 and D0 to D9 and so arranged as to project on each side of said orifices.

The block 14 is further provided with a series of cavities 22 intercalated between the ducts D0 to D9 and terminating on the side nearest the membrane 18 in orifices which are formed astride the partition-walls 15 of the plate 16.

The block 14 is additionally provided on each side of its series of ducts D0 to D9 with two outlet ducts 23, 24 as shown respectively from left to right in FIGS. 2 and 3. These outlet ducts open into the end cavities 22 of the block 14 which are each connected to the atmosphere through a discharge duct 25, 26 of small cross-sectional area.

The comparator 3 further comprises a third rigid block 28 which is separated from the block 14 by an elastic membrane 29 having a series of perforations 31. The block 28 is pierced by a series of ten transverse ducts F0 to F9 which are adapted to be put into communication with a second series (not shown in the drawings) of connecting pipes such as the pipes B0 to B9 of FIG. 1 for a fluid under pressure representing a second input signal. The axes of the ducts F0 to F9 are located in staggered relation to the axes of the ducts D0 to D9 but the orifices of the ducts F0 to F9 are partly located opposite to the orifices of the ducts D0 to D9. The perforations 31 of the membrane 29 are placed in front of the orifices of the ducts D0 to D9 and shut-off by the block 28 in the non-operating position.

The outlet ducts 23 and 24 of the block 14 communicate respectively through perforation 33 and 34 of the membrane 29 with outlet ducts 35 and 36 which traverse the block 28. Said ducts 35 and 36 are adapted to be put into communication with pipes (not shown in the drawings) for fluid under pressure such as the pipes 4 and 5 of FIG. 1 which represent an output signal of the comparator 3.

By way of example, in one embodiment of the invention, the following values have been adopted:

thickness of each membrane 17 and 18 : 0.3 mm
thickness of the intermediate plate 16 : 0.5 mm
pressure of the fluid representing the input signals : 0.3 to 10 bars.

The comparator which has just been described operates as follows (with reference to FIG. 3).

It is assumed that the fluid pressure representing the first input signal or so-called display signal is applied in the direction of the arrow *f* to the duct C5 of the block 12 and that the fluid pressure corresponding to the second input signal is applied in the direction of the arrow *g* to the duct F3 of the block 28. Under the action of the pressure which prevails within the duct C5, the membrane 17 is pushed through the open portion E5 against the membrane 18 and applies this latter forcibly against the orifice of the duct D5 of the block 14. Furthermore, the membrane 29 which is subjected to the pressure existing within the duct F3 is pushed back into the end of the duct D3 of the block 14, thereby freeing that portion of the membrane 29 which has a perforation 31. The pressure which prevails within the duct F3 is transmitted through said perforation 31 to the interior of the duct D3 and thrusts back the membrane 18 into the open portion E3. Since the openings of the cavities 22 are wider than the partition-walls 15, said pressure is transmitted from point to point across said cavities, both on the left and on the right-hand side of the duct D3. On the right-hand side, the propagation of said pressure is stopped by the deformed portion of the membrane 18 which shuts-off the orifice of the duct D5. On the left-hand side, the pressure propagates to the outlet ducts 23 and 35 and causes the emission of a "minus" output signal in the direction of the arrow *h;* this represents the fact that the "information" signal which arrives at F3 has a lower numerical value than the "display" signal which arrives at C5. In addition, the pressure which propagates from the duct D3 forcibly applies the membrane 29 against the block 28 at the ends of the ducts D0 to D2 and D4, the corresponding perforations 31 of the membrane 29 being thus perfectly shut-off by the block 28, thereby preventing any reaction of the input signal on the other ducts. After emission of the "minus" output signal and disappearance of the second input signal at F3, the ducts D0 to D4, 23 and 35 are restored to atmospheric pressure by means of the discharge duct 25. The cross-sectional area of said duct 25 is sufficiently small to avoid any interference with the emission of the output signal but remains sufficient to restore the ducts of the block 14 to atmospheric pressure prior to application of a further input signal.

If the second input signal is applied to one of the ducts F6 to F9 which are placed to the right of C5, the operation is similar but results in the emission of a "plus" output signal via the ducts 24 and 36.

If the second input signal is applied to the duct F5 which is located opposite to C5, the pressure cannot propagate either to the left or to the right and no output signal is emitted.

Figure 4:
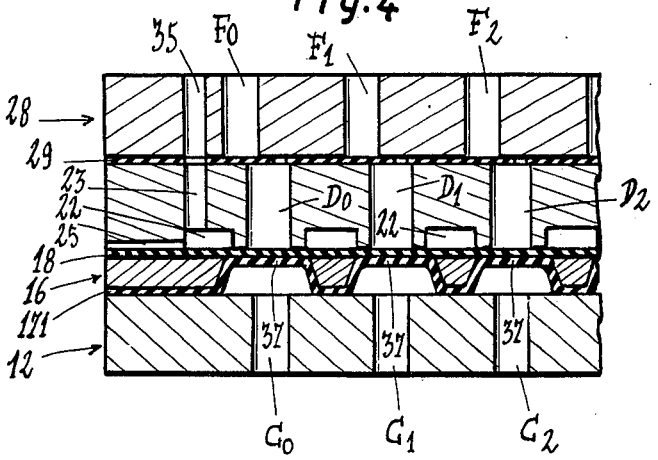
FIG. 4 is a fragmentary sectional view representing a second embodiment of the comparator of FIG. 1, said comparator being in the non-operating position.

FIG. 4 shows a variant of the embodiment which has just been described. In this alternative form, the membrane 171 which is placed between the block 12 and the intermediate plate 16 is provided opposite to each orifice of the ducts C0 to C9 with portions 37 which project into the open portions E0 to E9 of the plate 16.

This arrangement makes it possible to increase the thickness and therefore the strength of the plate 16 without entailing the need to increase the amplitude of deformation of the membrane 171 when this latter thrusts-back the membrane 18 in order to forcibly shut-off the orifice of one of the ducts D0 to D9.

Figure 5:
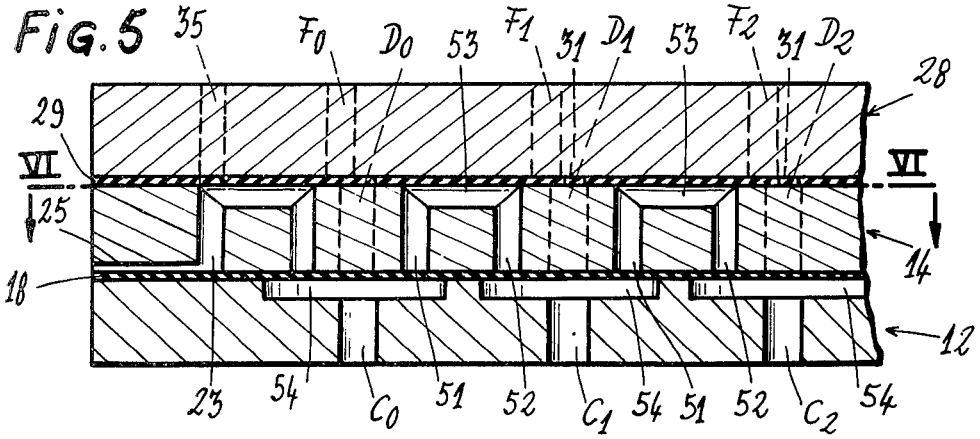
FIG. 5 is a fragmentary sectional view taken along line V—V of FIG. 6 and showing a third embodiment of the comparator of FIG. 1 in the non-operating position.
Figure 6:
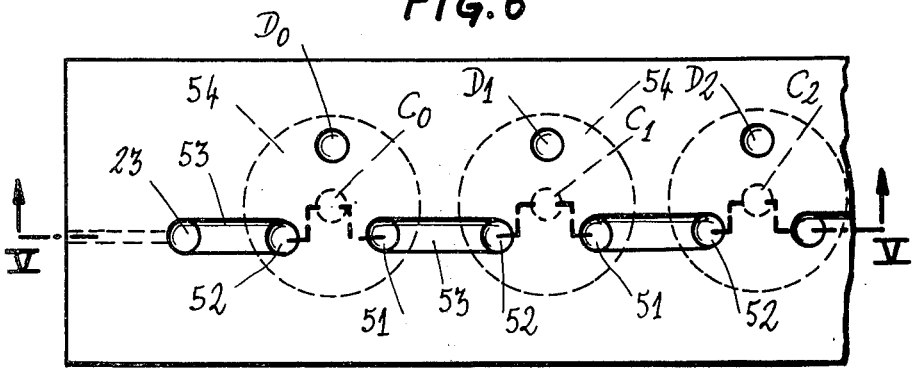
FIG. 6 is a plan view taken along line VI—VI of FIG. 5.
Figure 7:
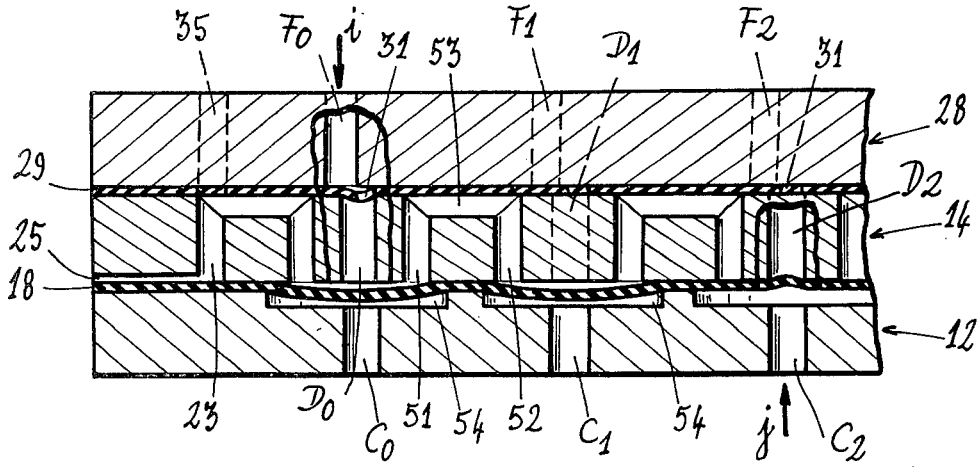
FIG. 7 is a view which is similar to FIG. 5 but in which the comparator is in the operating position.

In the third embodiment of the comparator which is illustrated in FIGS. 5 to 7, the intermediate plate 16 and the membrane 17 are dispensed with, the blocks 12 and 14 being separated only by the membrane 18.

The ducts D0 to D9 of the block 14 are disposed with respect to the ducts F0 to F9 of the block 28 in the same manner as in the previous embodiments. On the other hand, said ducts D0 to D9 are no longer coaxial with the ducts C0 to C9 of the block 12 as is apparent from FIG. 6. The block 14 is further provided between each duct D with two auxiliary ducts 51 and 52 which are in parallel relation to the ducts D. Said ducts 51, 52 open at one end on the membrane 18 and are connected to each other at the opposite end by means of a transverse duct 53. At both ends of the block 14, a duct 52 or 51 as the case may be is connected by means of a duct 53 to the outlet duct 23 or 24.

The ducts C0 to C9 of the block 12 open into chambers 54 which are limited by the membrane 18 and are of circular cross-section, for example. The dimensions of said chambers are such that one duct D and the ducts 51 and 52 located on each side of said duct open on the membrane 18 opposite to one and the same chamber 54, as shown in FIG. 6. The cavities 22 of the previous embodiments are dispensed with.

If it is assumed that a fluid pressure representing the display signal is applied in the direction of the arrow *j* to the duct $C_2$ of the block 12 and that another pressure representing the second input signal is applied in the direction of the arrow *i* to the duct $F_0$ of the block 28, the membrane 18 is forcibly applied by pressure against the block 14 over the entire cross-sectional area of the chamber 54 which corresponds to the duct $C_2$, as shown in FIG. 7.

Furthermore, the pressure of the duct $F_0$ deforms the membrane 29 as has been explained in the foregoing and is transmitted to the duct $D_0$, then deforms the membrane 18 from this point. The ends of the adjacent ducts 51 and 52 are thus freed, with the result that said pressure can accordingly be transmitted from point to point both to the right and to the left of the duct D0 through the successive ducts 51, 53, 52. On the right-hand side, the propagation of said pressure is stopped in front of the duct $C_2$ by the membrane 18 which is forcibly applied against the block 14. On the left-hand side, the pressure propagates to the outlet duct 23 and causes the emission of a "minus" signal through the duct 35.

This third embodiment not only calls for a smaller number of components than the two previous embodiments but offers an advantage over these latter in that a higher degree of leak-tightness of the membrane 18 is ensured in the portion in which it is applied against the block 14 by the first input signal. In fact, the pressure which represents said first signal produces direct action on said membrane 18 over the entire cross-sectional area of the corresponding chamber 54 whereas, in the previous embodiments, the membrane 18 is deformed as a result of the thrust exerted by the membrane 17 which in turn has to undergo relatively substantial deformation.

It is readily apparent that the invention is not limited to the embodiments which have just been described and that a large number of alternative forms of construction can be added to these latter without thereby departing either from the scope or the spirit of the invention.

What we claim is:

1. A comparator for signals which are coded in a predetermined number system and represented by a fluid pressure, wherein said comparator comprises a first and a second rigid block which are pierced by first and second series of transverse ducts arranged in rows to receive a fluid pressure representing respectively a first and a second input signal, at least one elastic membrane which separates the two blocks, a first and a second output duct pierced in the second block at each end of said second series of transverse ducts, means responsive to fluid pressure representing the second signal in order to deform the elastic membrane and to permit propagation of said pressure in the direction of said two output ducts, and means responsive to fluid pressure representing the first signal in order to deform the elastic membrane and to prevent propagation of said pressure representing said second input signal beyond the duct corresponding to said first input signal, the second block having between each said duct two adjacent auxiliary ducts, one end of each of said auxiliary ducts opening on the membrane, the other end of each of said auxiliary ducts being connected to each other, each duct of the first block opening into a chamber which is limited by the membrane and is so located that one duct of the second block and the two adjacent auxiliary ducts open on and are positioned to be closed by the membrane in front of said chamber upon application of said fluid pressure representing the first signal.

* * * * *